US006401789B1

(12) United States Patent
Allsopp

(10) Patent No.: US 6,401,789 B1
(45) Date of Patent: Jun. 11, 2002

(54) PLEATED BLIND

(75) Inventor: Reginald Charles Allsopp, Stockport (GB)

(73) Assignee: Louver-Lite Limited, Hyde (GB)

( * ) Notice: Subject to any disclaimer, the term of this patent is extended or adjusted under 35 U.S.C. 154(b) by 0 days.

(21) Appl. No.: 09/604,319

(22) Filed: Jun. 27, 2000

(30) Foreign Application Priority Data

Jun. 30, 1999 (GB) ..... 9915339

(51) Int. Cl.[7] ..... A47H 23/00
(52) U.S. Cl. ..... 160/84.06; 160/84.04
(58) Field of Search ..... 160/84.04, 84.06, 160/84.01, 172 R, 348

(56) References Cited

U.S. PATENT DOCUMENTS 4,501,311 A * 2/1985 Folland ..... 160/127
4,535,828 A * 8/1985 Brockhaus ..... 160/84.04
4,694,545 A * 9/1987 Dernis ..... 160/84.04 X
4,753,281 A * 6/1988 Wagner ..... 160/84.06
4,776,381 A * 10/1988 Riddiford ..... 160/84.06 X
4,880,044 A * 11/1989 Judkins ..... 160/84.04
5,139,069 A 8/1992 Hong
5,222,540 A 6/1993 Varga
5,551,500 A 9/1996 Allsopp
5,901,767 A * 5/1999 Ralton et al. ..... 160/84.04

FOREIGN PATENT DOCUMENTS

GB 2261691 5/1993

* cited by examiner

*Primary Examiner*—David M. Purol
(74) *Attorney, Agent, or Firm*—Dennison, Schultz & Dougherty

(57) ABSTRACT

A blind 10 which is particularly suitable for mounting at an angle to the vertical includes two rails, one fixed 12 and the other 14 moveable relative to it, and arranged therebetween a flexible sheet element 16 folded concertina fashion such that it can be folded between the rails when they are displaced towards one another. The blind includes a plurality of support members 22 attached to the sheet element which are slideably engageable with a fixed guide element 24. In a preferred embodiment each support member comprises an annular engagement portion 34 for receiving therethrough a guide element a T-shaped connecting portion 30, 32 extending from the annular engagement portion for attaching the support member to the sheet element.

14 Claims, 2 Drawing Sheets

PLEATED BLIND

This invention relates to an improved pleated blind and more particularly but not exclusively to pleated blinds for use with inclined openings.

BACKGROUND OF THE INVENTION

A pleated blind is normally arranged so that its fabric is folded in a concertina fashion between a top rail and a bottom rail. Conventionally, the pleated blind fabric is provided with holes through which a guide cable or rod can pass so t hat when the blind is mounted with its bottom rail at an angle to its top rail, it is maintained generally planar. That is to say, the blind fabric is prevented from sagging or bowing between the two rails. One problem with providing holes in the blind fabric is that the holes weaken the fabric material which can lead to fraying of the material around the holes.

A further problem is that blinds, and in particular triangular or circular blinds, often require several such guide cables or rods. This in turn necessitates that the blind fabric is provided with numerous sets of holes such that each guide rod or cable can pass through a respective set of holes. The provision of a large number of holes in the blind fabric reduces the effectiveness of the blind at cutting out or mitigating the amount of light which is allowed to pass through it. Thus, the holes in conventional blinds have a deleterious effect on the performance of the blind.

Furthermore, blinds having numerous holes therethrough have reduced aesthetic appeal to a user or prospective purchaser.

It would be advantageous to provide a pleated blind which overcomes or ameliorates at least some of the above-noted problems.

SUMMARY OF THE INVENTION

According to a first aspect of the present invention, there is provided a pleated blind including two rails and having arranged therebetween a flexible sheet element having a plurality of folds such that the flexible sheet element can be folded between the rails when they are displaced towards one another, and a plurality of support members attached to the sheet element, each of the support members being a one-piece construction including an engagement portion slidably engageable with a fixed guide element arranged transversely to the rails and as a connecting portion for attaching the support member to the flexible sheet, whereby the sheet element is supportable by the support element via the support members.

The provision of a blind including the flexible sheet element and the support members secured thereto obviates a need to provide the flexible sheet element with a plurality of holes through the pleats. This in turn reduces the risk of the flexible sheet element fraying and also increases the efficiency of the blind regarding its light transmission characteristics i.e. the amount of light the blind prevents or restricts passing therethrough. Additionally, in use, the support members are substantially invisible to the naked eye. This dramatically improves the aesthetic appeal of the blinds.

In a preferred embodiment, each support member is releasably secured to the sheet element substantially at a respective fold. More preferably, the folds to which the support members are attached are such that the portions of the sheet element which define the fold all project or extend in the same direction. In this arrangement, the engagement portions for the support members all lie in generally the same plane.

The engagement portion of the support member may comprise a loop or eye through which the support element may pass such that the eye or loop is slidably connectable to the guide element. The support member further includes a connecting portion extending from the engagement portion. The connecting portion more preferably is a T-shaped portion.

The support member is secured to the sheet element via the connection portion. This is desirably achieved by "punching" or urging the connecting portion through the sheet element such that a first part of the connecting portion (e.g. the shaft of a T-shaped connecting portion) extends through the sheet and a second part of the connecting portion (e.g. the cross bar of the T-shaped connecting portion) engages the front surface of the sheet element and thus resists removal of the support member from the sheet element. By front surface it is meant the surface of the sheet element which is furthest from the engagement portion of the support member.

Where a T-shaped connecting portion is provided, the cross bar of the T preferably includes flexible resilient arms. This makes it easier to secure the support member to the flexible sheet element.

Thus, when using a T-shaped connecting portion, the cross bar of the T is positioned adjacent to a surface of the flexible sheet (the rear surface). A force is then applied to the support member to urge it through the flexible sheet. The portion of the shaft to which the cross bar is connected penetrates the flexible sheet. The flexible arms are engaged by the sheet element and contrarotate about the shaft until they lie substantially parallel thereto. This configuration of the connecting portion permits it to pass through the sheet element with relatively little resistance. Once the arms of the cross bar are no longer engaged by the sheet element, they snap or spring back to their original configuration, i.e. perpendicular to the shaft. The connecting portion thus releasably secures the support member to the flexible sheet as the resilience of the arms of the cross bar resist removal of the connecting portion from the flexible sheet.

By punching or forcing the connection portion of the support member through the sheet element, a relatively small hole is made through the sheet element (i.e. the hole has a diameter which is only fractionally larger than the diameter of the first part of the connecting portion). This hole has a negligible effect on the structural integrity or strength of the sheet element. For example, where the sheet element comprises woven fabric, the act of punching the connecting portion of the support member through it merely results in a realignment of the warp and weft strands of the fabric; it does not typically result in the strands being severed. Thus, as the strands are maintained intact, the structural integrity or strength of the woven fabric remains unchanged. By "structural integrity", it is meant the ability of the sheet element to resist tearing, fraying or other actions that result in damage to the sheet element.

Even if the sheet element is a non-woven sheet-like material, the relatively small hole made therethrough by the connecting portion would have a negligible affect on the inherent strength or structural integrity of the sheet element. Accordingly, the sheet element is considerably less likely to fray around the hole made by the connecting portion of the support member.

Moreover, as the hole in the sheet element made by punching the connecting portion of the support member through it has a diameter substantially the same as the diameter of the shaft of the connecting portion, very little light can pass through the hole. Thus, the light restricting or suppressing ability of the blind is substantially not affected.

If, as in a preferred embodiment, the cross-bar of the connecting portion is either transparent or coloured a similar colour or tone as the colour or tone of the sheet element, the cross bar becomes generally invisible to the naked eye when the blind is in use. This results in the blind effectively having no visible means of support which in turn increases the aesthetic appeal of the blind.

The guide element with which the or each support member may be engaged is typically a cable under tension or a rod. That is to say, the guide element is preferably a rigid member. Moreover, more than one guide element may be used to support the flexible sheet element of the blind. Accordingly, the pleated blind may include a plurality of sets of support members, the support members is of each set being arranged, e.g. in a linear configuration, so that each set of support members may slideably engage a respective guide element. In a preferred embodiment, the or each guide element is fixed at one end thereof to one of the rails of the blind and at the other end thereof to a support surface outside of the blind. The other of the rails of the blind is provided with one or more apertures through which the or each guide elements may pass such that the other rail is slidably connectable to the guide element.

Preferably, the blind further includes a flexible being secured to the sheet element preferably by the connecting portions of at least some and more preferably all of the support members such that the unfolding of the sheet element is constrained by the connecting tape to a predefined maximum spacing between adjacent support members.

The connecting tape may be secured flexibly to the sheet element by the connecting portions of the support members so that some play is possible. This arrangement permits the flexible connecting tape to move and fold more freely during opening or closing of the blind. This in turn permits the sheet element to fold and move more freely. Desirably, the first part of the connecting portion, for example the shaft of the "T" where a T-shaped connecting portion is provided, passes through the sheet element and extends a short distance from both surfaces of the sheet element. Accordingly, the length of the first part of the connecting portion substantially determines the distance the connecting portion may extend from either surface of the sheet element. The amount of play is determined by this length of the first part of the connecting portion; the greater this length, the more play will be present.

Advantageously the or each flexible connecting tape is a ribbon or similar thin strip of material and the attachment points for securement of the flexible sheet element to the ribbon are equidistantly spaced along the ribbon length such that the folds will be similarly equidistantly constrained.

An embodiment of the invention will now be described by way of example only with reference to the accompany drawings in which:

DESCRIPTION OF THE PREFERRED EMBODIMENTS

Figure 1:
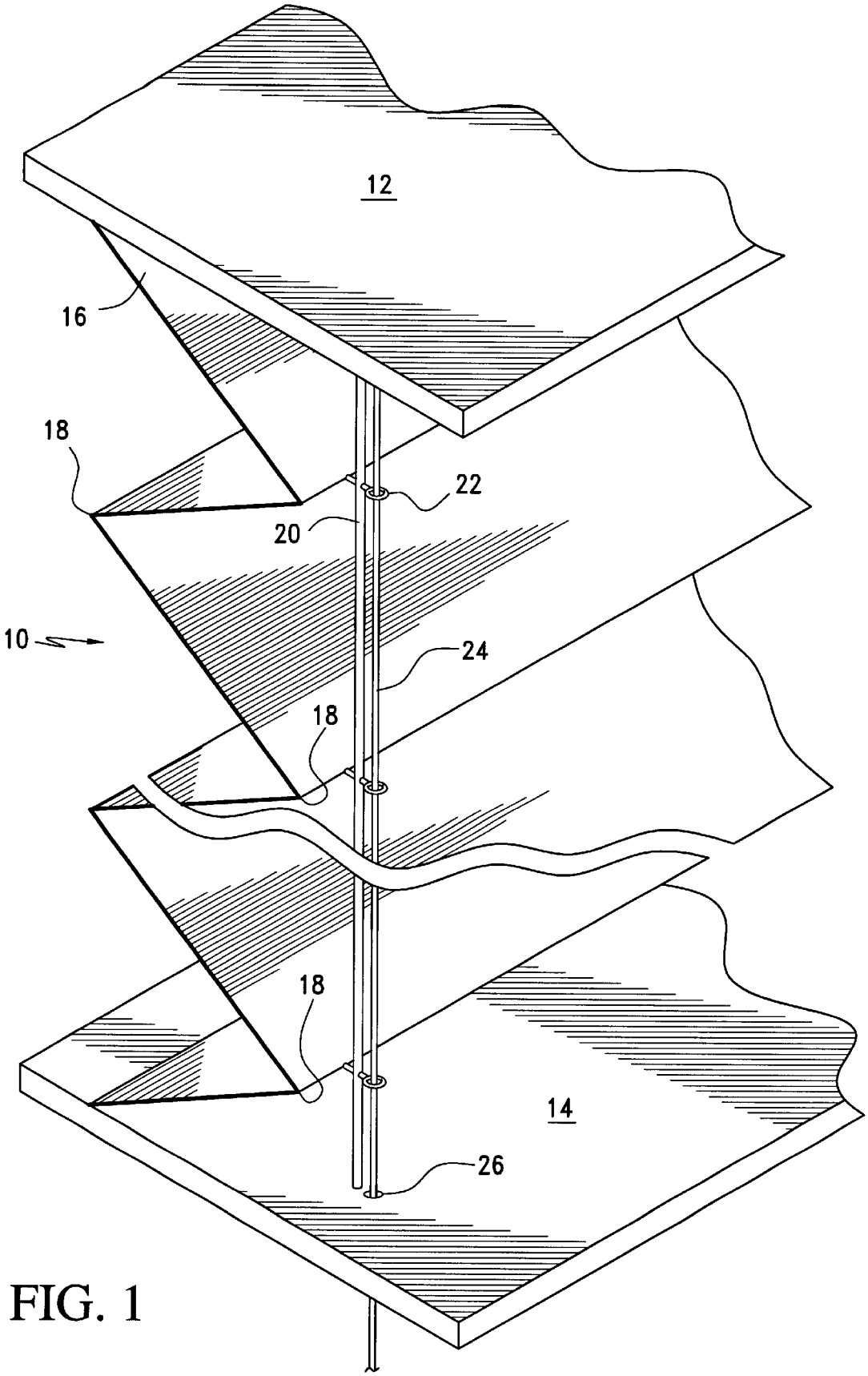
FIG. 1 is a perspective view of an embodiment of the present invention.
Figure 2:
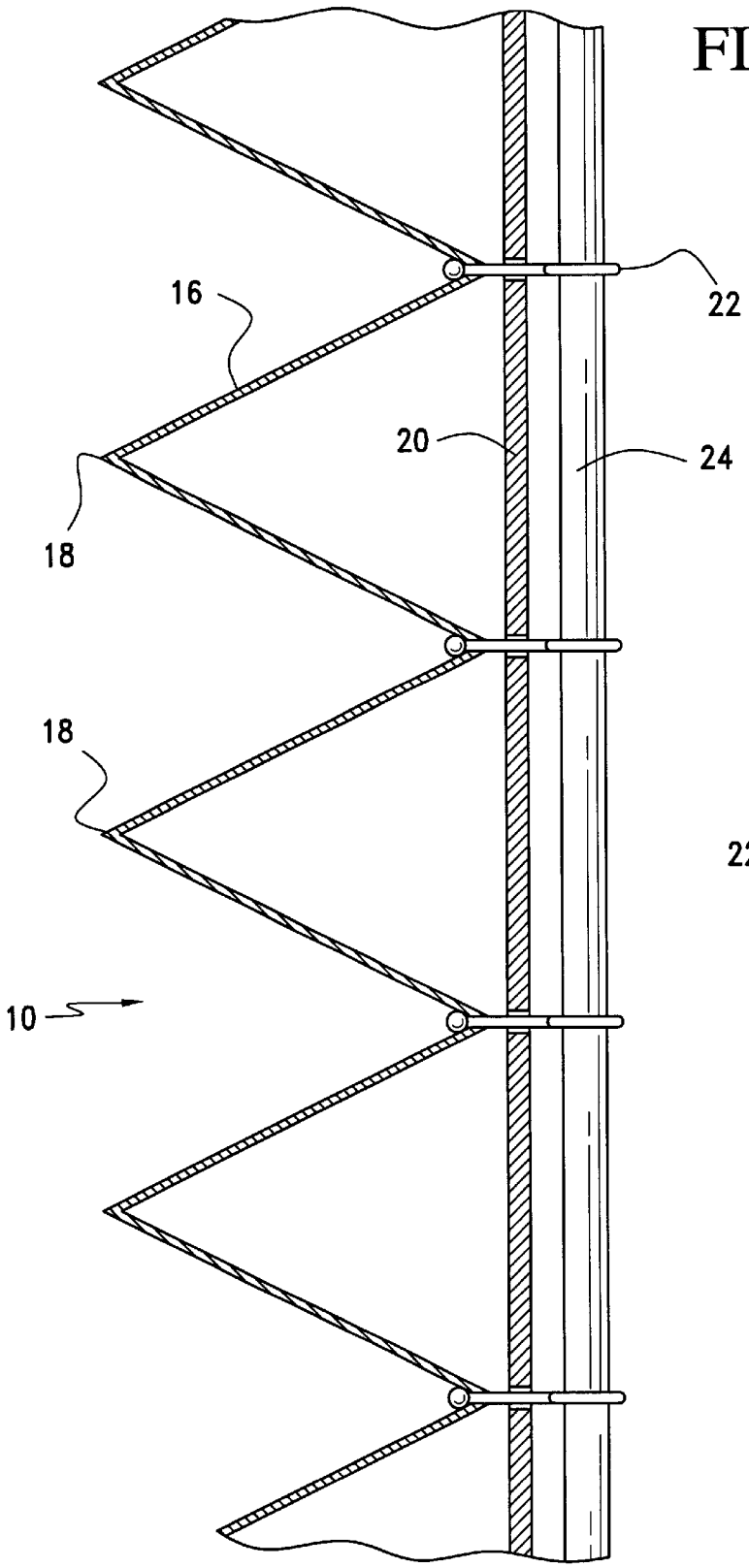
FIG. 2 is a cross-sectional end view of the embodiment of FIG. 1.

FIG. 1 shows an improved pleated blind referred to generally by the reference numeral 10, the blind having a top rail 12 the bottom rail 14. The bottom rail 14 is arranged to be displacable by blind control means (not shown) between a lowered position and a raised position. In the raised position, the bottom rail 14 is substantially adjacent to the top rail 12 and in a lowered position, the bottom rail 14 is arranged parallel to the top rail 12 and spaced from it. FIGS. 1 and 2 show the bottom rail 14 in a lowered configuration.

A flexible sheet element 16, for example a cloth or other textile material, is secured at one of its ends to the top rail 12 and at its other end to the bottom rail 14. The flexible sheet element 16 is provided with a plurality of pleats or folds 18 such that the sheet element 16 can be folded in a concertina-like fashion between the top and bottom rails 12, 14. This construction is substantially identical to known pleated blind assemblies.

In use, when the bottom rail 14 is displaced away from or lowered from the top rail 12, the flexible sheet element 16 is unfolded so as to form a blind or cover between the two rails 12, 14. It will be understood, however, that where the flexible sheet element 16 has an overall length greater than the distance between the top rail 12 and the bottom rail 14 there will remain a number of folds or pleats between the two rails even when the bottom rail 14 is spaced away from the top rail 12 by the maximum permitted displacement. The weight of the flexible sheet element 16 will have a tendency to pull the top portion of the sheet element 16 into a substantially planer configuration with a greater number of pleats or folds 18 occurring at the lower portion of the sheet element 16. Such an arrangement is not aesthetically pleasing and detracts from the overall appearance of the blind assembly 10.

In order to overcome this problem, a flexible support tape is provided by a ribbon 20 arranged between the top and bottom rails 12, 14. The ribbon 20 is attached to the sheet element 16 by a plurality of support members 22.

Figure 3:
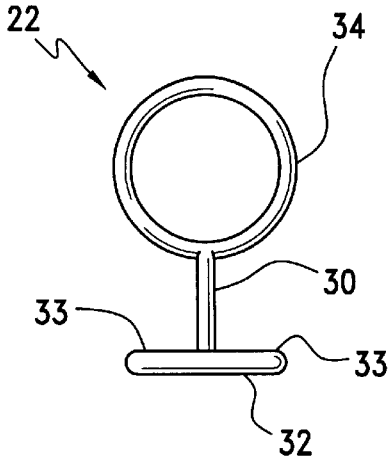
FIG. 3 is an enlarged view of a support member used in the embodiment shown in FIGS. 1 and 2.

A support member 22 is shown in more detail in FIG. 3 and includes a substantially annular engagement portion 34 and a T-shaped connecting portion consisting of a shaft 30 extending from the engagement portion 34 and a cross bar 32 transverse to the shaft 30. The support member 22 is arranged such that the engagement portion 34 extends from one end of the shaft 30 and the cross bar 32 extends from the other end of the shaft 30 with the shaft 30 located at the mid-point of the cross-bar 32.

The support member 22 is a one-piece construction formed of a flexible resilient plastics material, e.g. nylon.

The flexible ribbon 20 is arranged on one side (the rear surface) of the sheet element 16 such that the ribbon 20 lies adjacent alternate folds 18. A support member 22 is provided such that the shaft 30 passes through both the ribbon 20 and the fold 18 adjacent thereto. The support member 22 may connect the ribbon 20 to every fold 18 adjacent to the ribbon 20, or it may connect the ribbon 20 to every other fold 18 adjacent thereto.

In the process of producing the blind, the support member 22 is punched through both the ribbon 20 and the sheet element 16. Upon being punched through the ribbon 20 and fold 18 of the sheet element, the two arms 33 of the cross bar 32 are forced towards the shaft 30 until they are lying substantially parallel thereto. The thus formed arrow-like configuration allows for easy passage of the connecting portion of the support member 22 through the ribbon 20 and the sheet element 16. Once the cross bar 32 has passed through both the ribbon 20 and the sheet element 16, the two arms 33 snap back such that the connecting portion of the support member 22 regains its T-shaped configuration. The cross bar 32, once through both the ribbon 20 and the sheet element 16 and back in its T-shaped configuration, resists removal of the support member 22 from the sheet element 16.

The length of the shaft 30 is such that it extends a short distance beyond the sheet element 16 on the one side and a short distance beyond the ribbon 20 on the other side. By having both the ribbon 20 and a fold 18 of the sheet element 16 connected by the shaft 30 of the support member 22, there is a small amount of play resulting from the length of the shaft 30 which permits the sheet element 16 and the ribbon 20 to move and fold more freely during opening or closing of blind 10.

The support members 22 are arranged in sets (not shown), with each set having a linear configuration of support members 22. A guide element 24 in the form of a steel cord coated with a plastics material is arranged such that it passes through an engagement portion 34 of each of the support members 22 of a set thereof. The cord 24 is fixed at one of its ends to the top rail 12 and passes through an aperture 26 through the bottom rail 14 of the blind 10. The other end of the cord 24 is fixed to a suitable support surface (not shown). Thus, the bottom rail 14 and the set of support members 22 are slidably mounted to the cord 24 and are capable of being supported by it.

This arrangement is particularly useful for blinds 10 which are arranged to be used with conservatory roofs. In such an arrangement, the blind 10 is effectively mounted upside down. That is to say, rail 12 is fixed at a lower end of the conservatory roof window and rail 14 may be displaced upwardly at an angle (i.e. inclined) away from rail 12 such that when the blind 10 is in an open configuration, it is parallel to the inclined conservatory roof. The blind 10 and the cord 24 are arranged such that the cord 24, the support members 22 and the ribbon 20 are on the side of the sheet element 16 which is closest to the conservatory roof, i.e. not visible from within the conservatory.

The cord 24, which is under tension, lies parallel to the conservatory roof. Since the flexible sheet material 16 and the rail 14 are both supported by the cord 24, and the rail 12 is fixed relative to conservatory roof, the blind 10 is held generally parallel to the conservatory roof.

These preferred embodiments have been described by way of an example and it will be apparent to those skilled in the art that many alterations can be made that are still within the scope of the invention. For example, the support element (s) may be a nylon cable, or a metal or plastics material rod of suitable diameter.

What is claimed is:

1. A pleated blind including:

an upper rail and a lower rail, a flexible sheet element arranged therebetween having a plurality of folds such that the flexible sheet element can be folded between the upper rail and the lower rail when the lower rail is displaced towards the upper rail, a guide element arranged transverse to the upper and lower rails, fixed at one end thereof to the upper rail, extending through an aperture in the lower rail and being slidably coupled thereto, and constructed and arranged to be fixed at an opposite end thereof to a support surface which is not an element of the blind, whereby the guide element is fixed in position during displacement of the lower rail towards the upper rail, and a plurality of support members attached to the sheet element, each of the support members being a one-piece construction including an engagement portion slidably engaged with the guide element and a connecting portion for attaching the support member to the flexible sheet, whereby the sheet element is supported by the guide element via the support members.

2. A pleated blind according to claim 1 where in each support member is attached to the sheet element substantially at a respective fold.

3. A pleated blind according to claim 2 wherein the folds to which the support members are attached are such that the portions of the sheet element defining these folds project in the same direction.

4. A pleated blind according to claim 3 wherein adjacent support members are attached to alternate folds.

5. A pleated blind according to claim 1 wherein the support member engagement portion comprises an eye sized to be capable of receiving therethrough the guide element such that the support member is slidably connectable to the guide element.

6. A pleated blind according to claim 5 wherein the support member connecting portion extends from the engagement portion.

7. A pleated blind according to claim 6 wherein the connecting portion is a T-shaped portion.

8. A pleated blind according to claim 7 wherein the crossbar of the T-shaped portion includes flexible resilient arms.

9. A pleated blind according to claim 1 wherein the support member is substantially transparent.

10. A pleated blind according to claim 1 wherein the support member and the sheet element are substantially the same colour.

11. A pleated blind according to claim 1 wherein the blind includes a plurality of sets of support members, the support members of each set being configured so that each set is capable of engaging a respective guide element.

12. A pleated blind including:

an upper rail and a lower rail, a flexible sheet element having a plurality of folds such that the flexible sheet element can be folded between the upper rail and the lower rail when the lower rail is displaced towards the upper rail;

a guide element arranged transverse to the upper and lower rails, fixed at one end thereof to the upper rail, extending through an aperture in the lower rail and being slidably coupled thereto, and constructed and arranged to be fixed at an opposite end thereof to a support surface which is not an element of the blind, whereby the guide element is fixed in position during displacement of the lower rail towards the upper rail, a plurality of support members attached to the sheet element, each of the support members being a one-piece construction including an engagement portion slidably engaged with the guide element and a connecting portion for attaching the support member to the flexible sheet; and a flexible connecting tape disposed between the upper and lower rails, the connecting tape being secured to the sheet element such that the unfolding of the sheet element is constrained by the connecting tape to a predefined maximum spacing between adjacent folds, whereby the sheet element is supported by the guide element via the support members.

13. A pleated blind according to claim 12 wherein the tape is secured to the sheet element by at least some of the support members.

14. A pleated blind according to claim 13 wherein the attachment points of the tape at which it is secured to the sheet element are equidistantly spaced along the tape length such that the folds are similarly equidistantly constrained.

* * * * *